US010340664B2

(12) United States Patent
Pottiez et al.

(10) Patent No.: US 10,340,664 B2
(45) Date of Patent: Jul. 2, 2019

(54) CORONA IGNITION DEVICE

(71) Applicant: BorgWarner Ludwigsburg GmbH, Ludwigsburg (DE)

(72) Inventors: Christian Pottiez, Eppingen (DE); Simon Frank, Bönnigheim-Hofen (DE); Markus Müller, Tamm (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 293 days.

(21) Appl. No.: 15/009,545

(22) Filed: Jan. 28, 2016

(65) Prior Publication Data

US 2016/0226226 A1 Aug. 4, 2016

(30) Foreign Application Priority Data

Jan. 30, 2015 (DE) ..... 10 2015 101 374
Feb. 4, 2015 (DE) ..... 10 2015 101 568

(51) Int. Cl.

| | |
|---|---|
| ***H01T 13/02*** | (2006.01) |
| ***H01T 13/05*** | (2006.01) |
| ***H01T 19/04*** | (2006.01) |
| ***F02P 13/00*** | (2006.01) |
| ***H01T 13/44*** | (2006.01) |
| ***H01T 13/50*** | (2006.01) |
| *F02P 23/04* | (2006.01) |

(52) U.S. Cl.

CPC ..... *H01T 13/02* (2013.01); *H01T 13/05* (2013.01); *H01T 13/44* (2013.01); *H01T 13/50* (2013.01); *H01T 19/04* (2013.01); *F02P 13/00* (2013.01); *F02P 23/04* (2013.01)

(58) Field of Classification Search

CPC ..... H01T 19/04; H01T 13/00–05; F02P 13/00
See application file for complete search history.

(56) References Cited

U.S. PATENT DOCUMENTS 4,767,967 A * 8/1988 Tanaka ..... F02P 3/12 310/318
6,467,447 B1 * 10/2002 Holmes ..... F02P 13/00 123/169 PA (Continued)

FOREIGN PATENT DOCUMENTS

DE 10 2013 104 643 B3 6/2014
DE 10 2013 110 246 A1 3/2015

OTHER PUBLICATIONS

JP 2014-095105. May 2, 2014.*
DE 10 2014 101 967.9. Feb. 17, 2014. (Year: 2014).*

*Primary Examiner* — Ronald W Leja
*Assistant Examiner* — Christopher J Clark
(74) *Attorney, Agent, or Firm* — Bose McKinney & Evans LLP

(57) ABSTRACT

A corona ignition device is described, with a central electrode, an insulator, in which the central electrode sits, a coil, which is connected to the central electrode, a metal housing, which holds the insulator and surrounds the coil, and a cover, which closes the metal housing at its end facing away from the insulator. According to this disclosure, provision is made for a spring arranged between the cover and the coil. In another aspect, a shield is provided that surrounds the housing and comprises several shell elements which each surround a section of the circumference of the coil.

11 Claims, 3 Drawing Sheets

(56) References Cited

U.S. PATENT DOCUMENTS

| | | | | |
|---|---|---|---|---|
| 9,728,322 | B2 * | 8/2017 | Sano | H01F 27/29 |
| 2006/0148338 | A1 * | 7/2006 | Virchow | H01R 24/20 439/851 |
| 2012/0180743 | A1 | 7/2012 | Burrows et al. | |
| 2013/0155570 | A1 * | 6/2013 | Stifel | H01T 13/44 361/263 |
| 2013/0199484 | A1 * | 8/2013 | Stifel | H01T 13/467 123/143 B |
| 2014/0137845 | A1 * | 5/2014 | Achtstatter | H01T 13/34 123/634 |
| 2014/0328002 | A1 * | 11/2014 | Silva | H01T 13/05 361/254 |
| 2014/0328003 | A1 * | 11/2014 | Achtstatter | H01T 13/50 361/263 |
| 2015/0075472 | A1 | 3/2015 | Achtstatter et al. | |
| 2015/0114095 | A1 * | 4/2015 | Hatta | B23K 15/0006 73/114.18 |
| 2015/0236481 | A1 * | 8/2015 | Achtstatter | H01T 13/04 313/144 |
| 2015/0318672 | A1 * | 11/2015 | Iwasaki | H01T 13/41 315/52 |
| 2017/0152829 | A1 * | 6/2017 | Ikeda | F02P 23/045 |

* cited by examiner

CORONA IGNITION DEVICE

RELATED APPLICATIONS

This application claims priority to DE 10 2015 101 374.6, filed Jan. 30, 2015, and also claims priority to DE 10 2015 101 568.4, filed Feb. 4, 2015, both of which are hereby incorporated herein by reference in their entireties.

BACKGROUND

The invention refers to a corona ignition device. Corona ignition devices are known, e.g., from DE 10 2013 104 643 B3 and are used for igniting fuel in an internal combustion engine. In motor vehicles, corona ignition devices are exposed not only to thermal stresses by the operation of the engine, but also to considerable mechanical stresses, which occur from shocks and vibrations during the journey.

SUMMARY

This disclosure teaches how a mechanically robust corona ignition device can be manufactured in a cost-efficient manner.

In the housing of a corona ignition device according to this disclosure, a spring is arranged between coil and cover. This spring is a compression spring which presses the coil towards the central electrode and therefore compensates manufacturing tolerances in the length of the housing, the length of the coil or the central electrode. Advantageously, therefore, a compression spring mounted between cover and coil, despite length- and position tolerances, can fix the coil in the housing. The corona ignition device can therefore better withstand the mechanical stresses occurring during the driving operation.

An advantageous further refinement of this disclosure makes provision that the compression spring is a metal plate having spring lugs. The metal plate has an opening through which an electrical connection of the coil is directed. Such a metal plate with spring lugs can be stamped out from sheet metal in a cost-efficient manner, wherein the spring lugs are bent out from the plane of the plate. The spring lugs can rest on the cover or can face the coil.

An additional advantage of a compression spring in the form of a metal plate with spring lugs is that the metal plate can complete a shielding of the coil in the axial direction, which can be, for example a radial sheet metal casing of the coil. For this, it is advantageous if the metal plate has a high electrical conductivity, for example by being produced from copper, aluminium or silver, or carries a highly conductive coating, for example of copper, aluminium, gold or silver, on its side facing the coil. Such a coating is preferably at least 0.1 mm thick. A coating can be applied for example by electroplating or by roll cladding on sheet metal, for example sheet steel.

This disclosure also shows how a corona ignition device can be provided economically with an electromagnetic shield. The function of an electromagnetic shield is to reduce eddy current losses.

This is achieved by arranging a shield that comprises several shell elements around the coil. Shell elements can be made from sheet metal at low cost. Such shell elements can be arranged around the coil. Such shell elements are cheaper than a tube. The shell elements may be made of aluminium, copper, silver or gold, for example.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
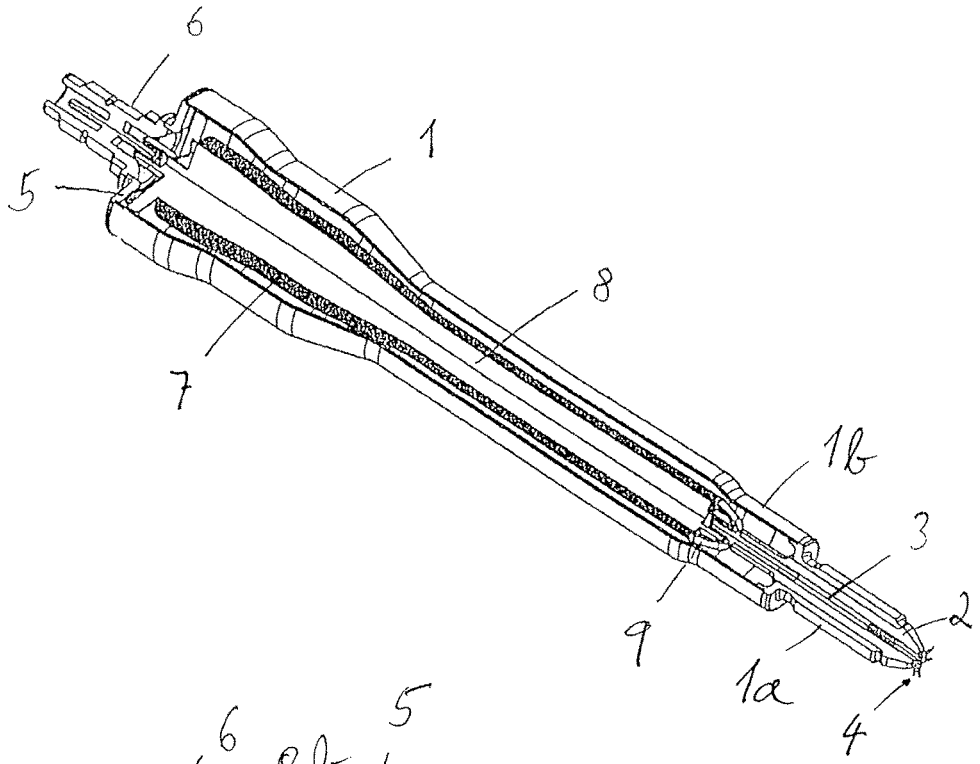
FIG. 1 is a view, partially in section, of an illustrative embodiment of a corona ignition device according to this disclosure.
Figure 2:
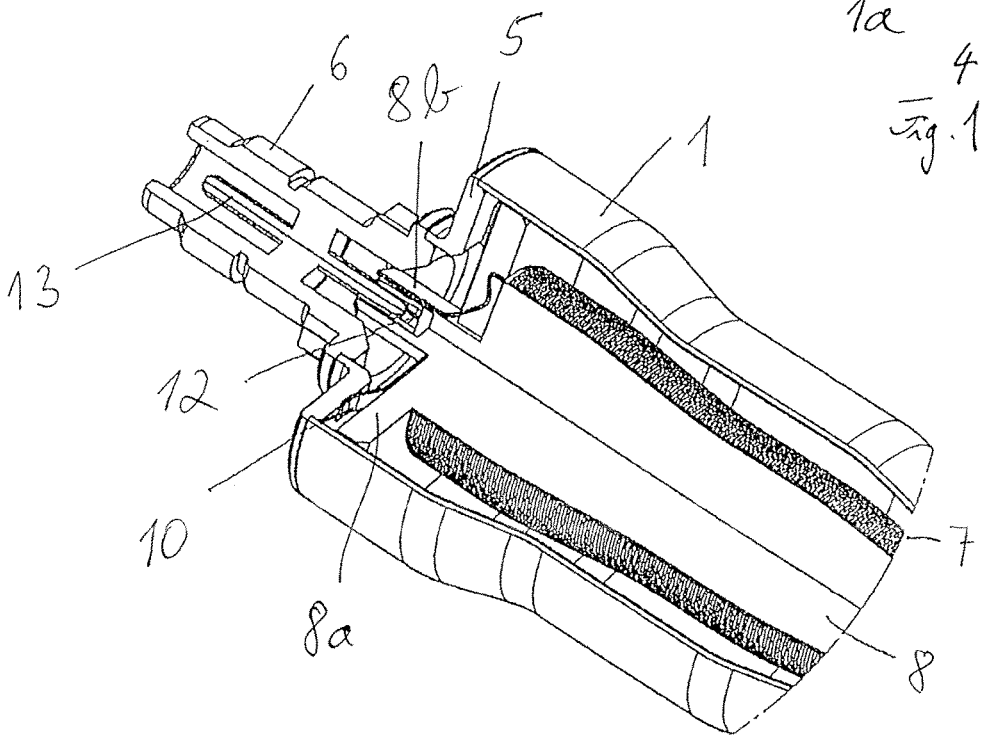
FIG. 2 is a detail view to FIG. 1.

The corona ignition device shown in FIG. 1 has a housing 1, which is closed at a front end on the combustion chamber side by an insulator 2, in which a central electrode 3 sits, which leads to one or more ignition tips 4. At its rear end remote from the combustion chamber, the housing 1 is closed by a cover 5 which carries a plug connector 6, by which the corona ignition device can be connected to a voltage source. The housing can be a metal housing which holds the insulator and surrounds the coil.

The central electrode 3 is connected in series with a coil 7. The coil 7 is wound onto a coil former 8, which is plugged together with the central electrode 3. This plug connection between coil former 8 and central electrode 3 can have a shield cap 9, which surrounds the electrical connection site between coil 7 and central electrode 3. In addition to the mechanical connection of coil former 8 and central electrode 3, the plug connection also brings about an electrical connection between the coil former 8 and the central electrode 3.

A front housing part 1*a*, which holds the insulator 2, is welded to a housing part 1*b* adjoining thereon, and the coil 7 with its coil former 8 is connected by inserting into one another with the central electrode 3. The front housing part 1*a* forms a stop, on joining together of the two housing parts 1*a* and 1*b*, for example by the front housing part 1*a* having an annular shoulder, onto which a tubular housing part 1*b* is placed. The coil former 8, on joining onto the central electrode 3, can likewise be mounted in abutment, wherein the stop can be formed for example by the central electrode 3 or the insulator 2.

Figure 3:
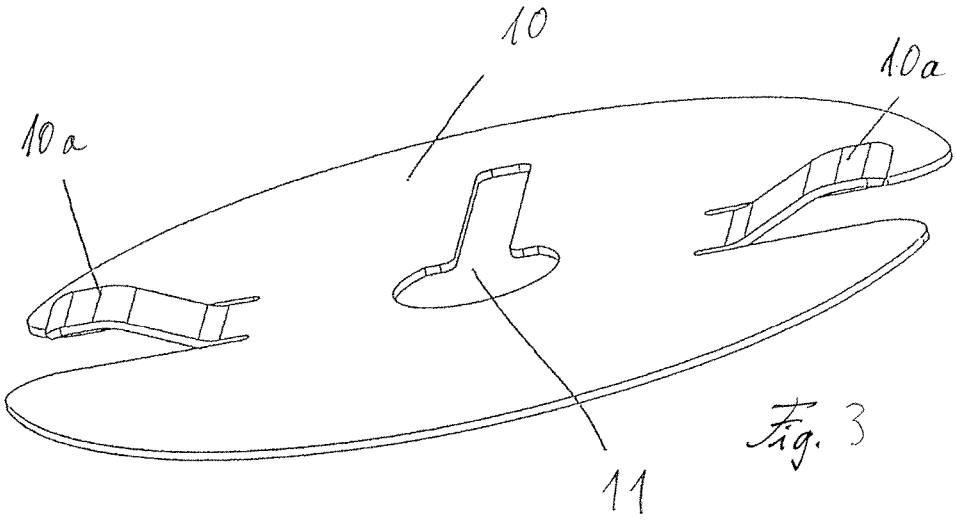
FIG. 3 is an illustrative embodiment of the compression spring arranged between cover and coil of the illustrated corona ignition device.

The tolerances which are adding together during assembly are compensated by a compression spring 10, which is mounted between the coil 7 and the cover 5. An example embodiment of such a compression spring is illustrated in FIG. 3. After the compression spring 10 has been placed onto the coil former 8, the cover 5 is welded to the housing 1.

The compression spring can be, for example, a metal plate having spring lugs 10*a*, which has an opening 11 through which an electrical connection 12 of the coil 7 is directed. The metal plate with spring lugs 10*a* can be produced as a stamped-bent part of sheet metal. In the illustrated example embodiment, the spring lugs 10*a* rest on the cover 5, whilst the metal plate itself lies against a flange 8*a* of the coil former 8. An extension 8*b* of the coil former 8 projects through the opening of the metal plate 11. This extension 8*b* can carry an electrical connection of the coil 7, for example a contact pin 13 of the plug connector 6.

The compression spring 10 can be produced for example from steel or bronze and can be provided with a highly conductive coating, for example of copper, gold, silver or aluminium, in order to reduce eddy current losses. It is sufficient here to apply the coating on the side of the compression spring 10 which faces the coil 7. When the coating is applied by electroplating, it can be advantageous from the manufacturing point of view to apply the coating on both sides. The coating can also be applied for example by roll cladding onto a metal sheet from which then the compression spring 10 is produced.

For the reduction of eddy current losses, the inner side of the housing 1 can be provided with a conductive layer, for example of copper, silver, aluminium or gold. As an alternative to a coating of the housing 1, the coil can be surrounded in the housing 1 radially by a shield of sheet metal, for example of copper or aluminium. The shield 12 is shown in FIGS. 4 and 5.

Figure 4:
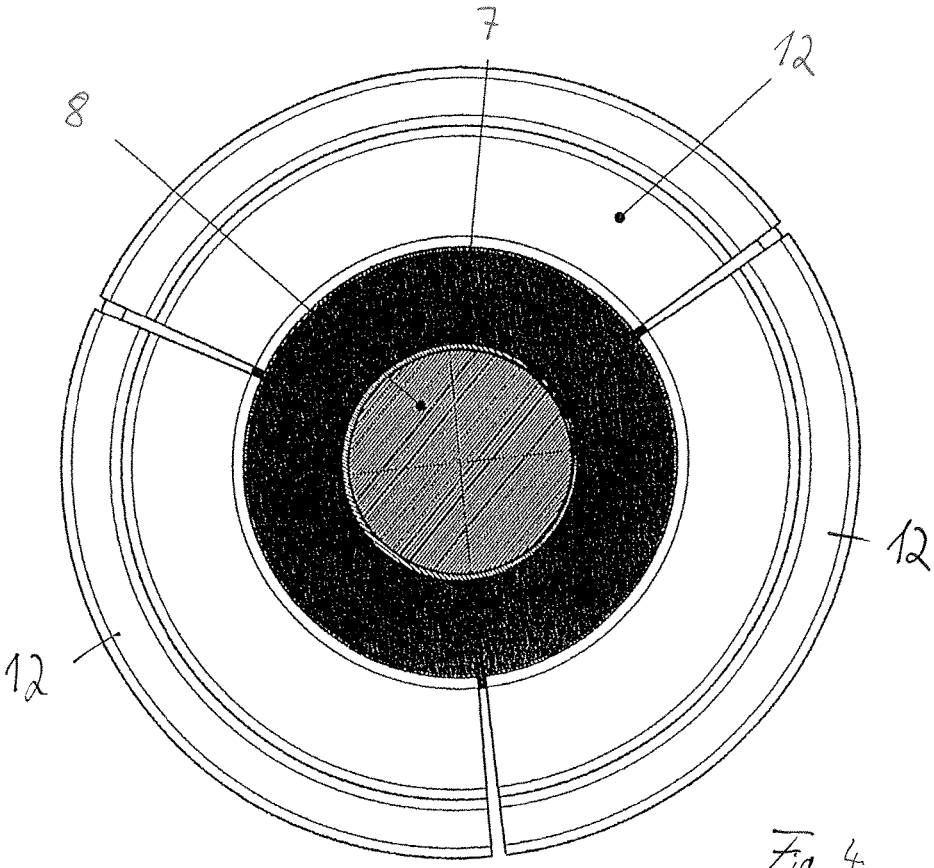
FIG. 4 is a cross-sectional view of the corona ignition device without the housing.
Figure 5:
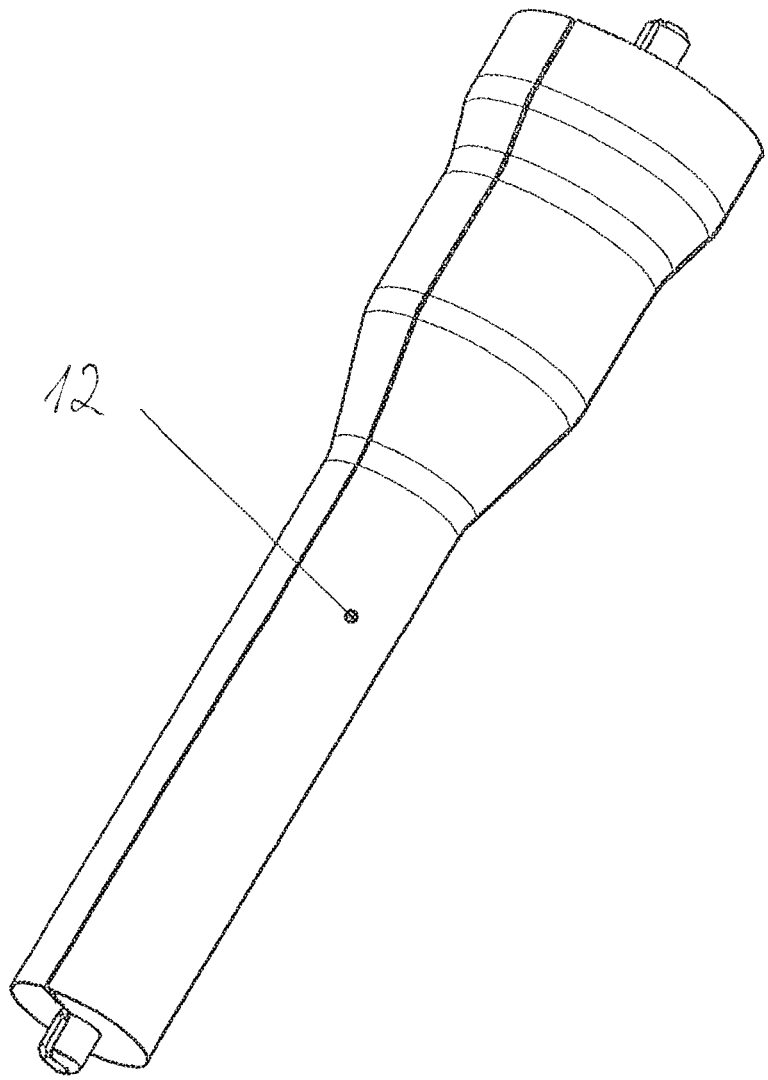
FIG. 5 shows the shield of the corona ignition device.

FIG. 4 shows a cross-sectional view of the corona ignition device without the housing 1. The coil 7 is radially surrounded by a shield that comprises several shell elements 12 which each extend along a section of the coil circumference. The shield may lie flat on the inside of the housing 1.

The shell elements 12 are made of sheet metal. A gap may be present between neighbouring shell elements 12 in order to reduce eddy current losses even more. The corona ignition device may comprise three shell elements 12 so that the shield has three gaps that extend in longitudinal direction of the coil 7.

The shell elements 12 can be carried by the coil former 8. For example the coil former 8 may comprise a flange 8*a* on which the shell elements 12 may be fixed, e.g., by an adhesive.

The coil 7 has a smaller radius at its end facing the insulator 2 than at its end facing away from the insulator. The shell elements 12 have a larger circumferential width at their end facing away from the insulator 2 than at their end facing the insulator 2.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE NUMBERS

1 housing
2 insulator
3 central electrode
4 ignition tip
5 cover
6 plug connector
7 coil
8 coil former
8*a* flange
8*b* extension
9 shield cap
10 compression spring
10*a* spring lug
11 opening
12 Shell element

What is claimed is:

1. A corona ignition device, comprising:
a central electrode;
an insulator in which the central electrode sits;
a coil connected to the central electrode;
a housing which holds the insulator and surrounds the coil;
a cover which closes the housing at an end facing away from the insulator; and
a spring arranged between the cover and the coil, wherein the spring comprises a metal plate having spring lugs.

2. The corona ignition device according to claim 1, wherein the spring comprises an opening through which an electrical connection of the coil is passed.

3. The corona ignition device according to claim 2, wherein the coil is wound onto a coil former having an extension which carries an electrical connection of the coil and projects through the opening of the metal plate.

4. The corona ignition device according to claim 3, wherein the coil former has a flange, against which the metal plate presses.

5. The corona ignition device according to claim 2, wherein the metal plate has at least on a side facing the coil a surface of aluminium, copper, gold or silver.

6. The corona ignition device according to claim 2, wherein the metal plate is coated at least on a side facing the coil.

7. The corona ignition device according to claim 3, wherein the coil former and the central electrode are plugged together.

8. The corona ignition device according to claim 1, wherein the cover carries a plug connector connected to the coil.

9. The corona ignition device according to claim 1, wherein a shield is arranged in the housing and surrounds the coil.

10. A corona ignition device, comprising:
a central electrode;
an insulator in which the central electrode sits;
a coil connected to the central electrode;
a housing which holds the insulator and surrounds the coil;
a cover which closes the housing at an end facing away from the insulator; and
a shield that surrounds the coil and comprises several shell elements which each surround a section of the circumference of the coil, wherein the coil comprises a coil former, said coil former comprising a flange on which the shell elements are fixed by an adhesive.

11. The corona ignition device according to claim 10, wherein there is a gap between adjacent shell elements that extends in a longitudinal direction of the coil.

* * * * *